US005971776A

United States Patent [19]

Neel et al.

[11] Patent Number: 5,971,776

[45] Date of Patent: Oct. 26, 1999

[54] ADJUSTABLE SPARK PLUG BOOT

[75] Inventors: John E. Neel; John Eric Walters, both of Jasper, Ga.

[73] Assignee: Lexington Insulators, Jasper, Ga.

[21] Appl. No.: 08/851,587

[22] Filed: May 5, 1997

[51] Int. Cl.[6] ..... H01R 13/44

[52] U.S. Cl. ..... 439/125; 439/933

[58] Field of Search ..... 439/125–128, 439/933

[56] References Cited

U.S. PATENT DOCUMENTS

| | | | |
|---|---|---|---|
| 3,874,760 | 4/1975 | Guthmiller et al. | 439/60 |
| 4,063,793 | 12/1977 | Judd | 439/60 |
| 4,702,710 | 10/1987 | Dittman et al. | 439/125 |
| 4,713,015 | 12/1987 | Takiguchi | 439/125 |
| 4,721,474 | 1/1988 | Kanno et al. . | |
| 4,797,115 | 1/1989 | Sturdevan et al. . | |
| 4,880,389 | 11/1989 | Mochizuki et al. . | |
| 4,938,705 | 7/1990 | Kanno et al. . | |
| 4,947,809 | 8/1990 | Hocking . | |
| 4,997,380 | 3/1991 | Etienne et al. . | |
| 5,267,869 | 12/1993 | Nadasky et al. | 439/125 |
| 5,382,170 | 1/1995 | Imanishi . | |
| 5,456,609 | 10/1995 | Imanishi . | |

*Primary Examiner*—Paula Bradley
*Assistant Examiner*—Katrina Davis
*Attorney, Agent, or Firm*—Nixon, Hargrave, Devans & Doyle LLP

[57] ABSTRACT

An adjustable spark plug boot in accordance with the present invention includes an assembly, a first groove, a first terminal locator chamber, and a second terminal locator chamber. The assembly has first and second ends with a bore extending from the first end to the second end. The assembly includes an elongated section which extends from the first end along a first axis. The first groove extends at least partially around an outer surface of the elongated section and is in a plane which is substantially perpendicular to the first axis. The first terminal locator chamber is located in the bore in the elongated section. The second terminal locator chamber is also located in the bore in the elongated section and adjacent to the first chamber. The first chamber may have a first side which is opposite from the first end and is spaced a first distance from the first end and the second chamber may have a second side which is opposite from the first end and is spaced the first distance from the first groove. The first chamber and the second chamber may also have substantially the same first width along the first axis and the first groove may have a second width along the first axis which is smaller than the first width.

18 Claims, 5 Drawing Sheets

ADJUSTABLE SPARK PLUG BOOT

FIELD OF THE INVENTION

This invention relates to an adjustable spark plug boot for an engine.

BACKGROUND OF THE INVENTION

Referring to FIGS. 1(*a–c*), three prior art spark plug boots 10(1), 10(2), and 10(3) are illustrated. Each of these prior spark plug boots 10(1), 10(2), and 10(3) includes a rubber bushing 12, a plastic tube 14, and a rubber cap 16. The spark plug boots 10(1), 10(2), and 10(3) are assembled by gluing the rubber bushing 12 and the rubber cap 16 to opposing ends of the plastic tube 14. A spark plug wire (not shown) is threaded through the rubber cap 16 and into the plastic tube 14. The spark plug wire includes a connector (not shown) which is connected to a terminal end of a spark plug (not shown) when the terminal end is inserted into the rubber bushing 12.

To accommodate different types of internal combustion engines, spark plug boots 10(1), 10(2), and 10(3) typically come in three different lengths, 5.18", 5.88", and 6.26". The length of each spark plug boot 10(1), 10(2), and 10(3) is measured from one end of rubber bushing 12 to the center of an opening in rubber cap 16. The length of each of the prior art spark plug boots 10(1), 10(2), and 10(3) shown in FIGS. 1(*a–c*) is adjusted by simply changing the length of the plastic tube 14 used.

Although the prior art spark plug boots 10(1), 10(2), and 10(3) discussed above work, there are problems with its design. One of the main problems is that a manufacturer, repair shop, or parts store must maintain an inventory of the three different lengths of spark plug boots 10(1), 10(2), and 10(3) to accommodate the different types of engines. This adds significantly to the overhead costs for these businesses. Another problem is that the manufacture of the prior art spark plug boot 10 is time consuming and expensive because the rubber bushing 12 and rubber cap 16 must be glued to the plastic tube 14 and because multiple tools are required to produce the different lengths of spark plug boots 10(1), 10(2), and 10(3).

SUMMARY OF THE INVENTION

An adjustable spark plug boot in accordance with the present invention includes an assembly, a first groove, a first terminal locator chamber, and a second terminal locator chamber. The assembly has first and second ends with a bore extending from the first end to the second end. The assembly includes an elongated section which extends from the first end along a first axis. The first groove extends at least partially around an outer surface of the elongated section and is in a plane which is substantially perpendicular to the first axis. The first terminal locator chamber is located in the bore in the elongated section. The second terminal locator chamber is also located in the bore in the elongated section and adjacent to the first chamber. The first chamber may have a first side which is opposite from the first end and is spaced a first distance from the first end and the second chamber may have a second side which is opposite from the first end and is spaced the first distance from the first groove. The first chamber and the second chamber may also have substantially the same first width along the first axis and the first groove may have a second width along the first axis which is smaller than the first width.

The adjustable spark plug boot may also include a second groove and a third terminal locator chamber. The second groove extends at least partially around the outer surface of the elongated section, is substantially perpendicular to the first axis, and is spaced from the first groove. The third terminal locator chamber is located in the bore in the elongated section and is adjacent to the second chamber. The third chamber has a third side which is opposite from the first end and is spaced the first distance from the second groove. The third chamber has substantially the same width along the first axis as the first chamber and the second chamber and the second groove has a third width along the first axis which is smaller than the first width.

The adjustable spark plug boot in accordance with the present invention provides several advantages. One of the main advantages is that with the adjustable spark plug boot, a manufacturer, repair shop, or parts store only needs to maintain an inventory of one set of spark plug boots because the one spark plug boot can be adjusted to the three different required lengths. As a result, these businesses are able to significantly reduce their overhead for stocked parts. Another advantage is that the adjustable spark plug boot can be more easily and cheaply manufactured than the prior spark plug boots because it does not involve any assembly steps and requires only one mold to manufacture.

BRIEF DESCRIPTION OF THE DRAWINGS

FIG. 4(*b*) is a partial, cross-sectional view of the spark plug boot shown in FIG. 4(*a*) with a spark plug coupled to the boot;

FIG. 5(*b*) is a partial, cross-sectional view of the spark plug boot shown in FIG. 5(*a*) with a spark plug coupled to the boot;

FIG. 6(*b*) is a partial cross-sectional view of the spark plug boot shown in FIG. 6(*a*) with a spark plug coupled to the boot;

DETAILED DESCRIPTION

Figure 1A:
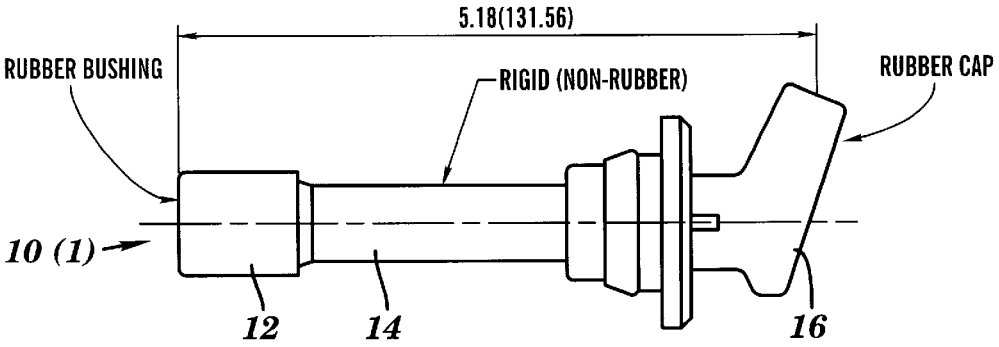
FIG. 1(a) PRIOR ART
FIGS. 1(*a–c*) are side views of prior art spark plug boots.
Figure 1B:
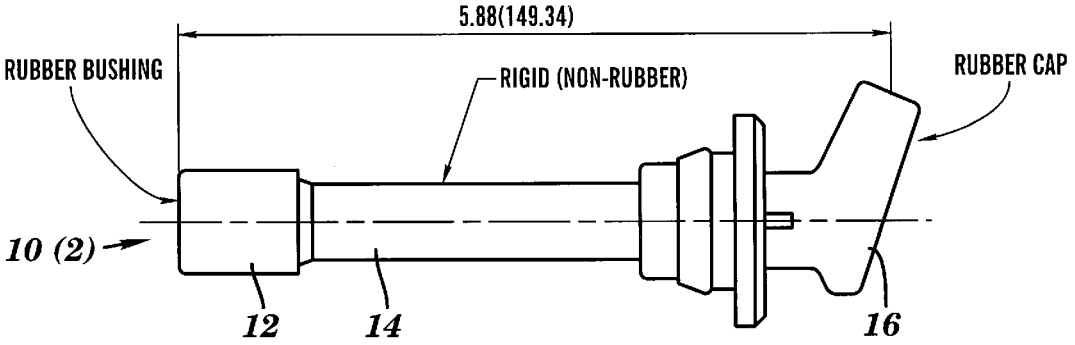
FIG. 1(b) PRIOR ART
Figure 1C:
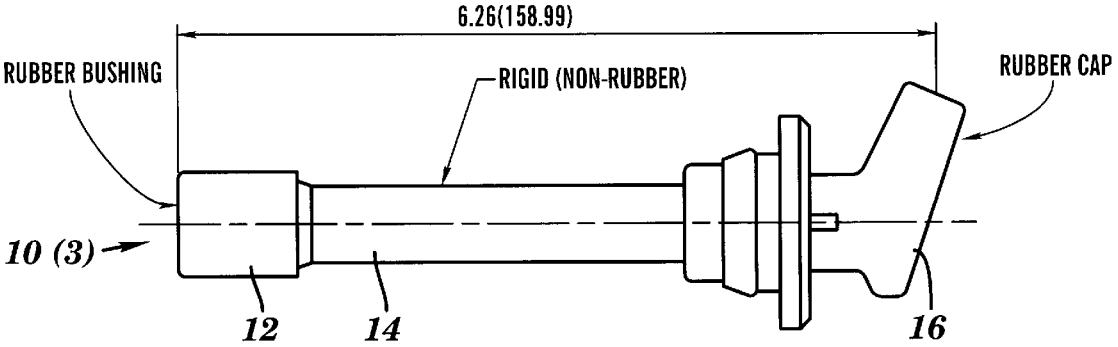
FIG. 1(c) PRIOR ART

An adjustable spark plug boot 18 in accordance with the present invention is illustrated in FIGS. 2–6. The adjustable spark plug boot 18 includes an assembly 20, a first groove 22, a first terminal locator chamber 24, and a second terminal locator chamber 26. The adjustable spark plug boot 18 may also include a second groove 28 and a third terminal locator chamber 30. The adjustable spark plug boot 18 provides a number of advantages including reducing the amount of inventory of spark plug boots 18 a business needs and reducing the manufacturing costs for making the spark plug boots 18.

Figure 2:
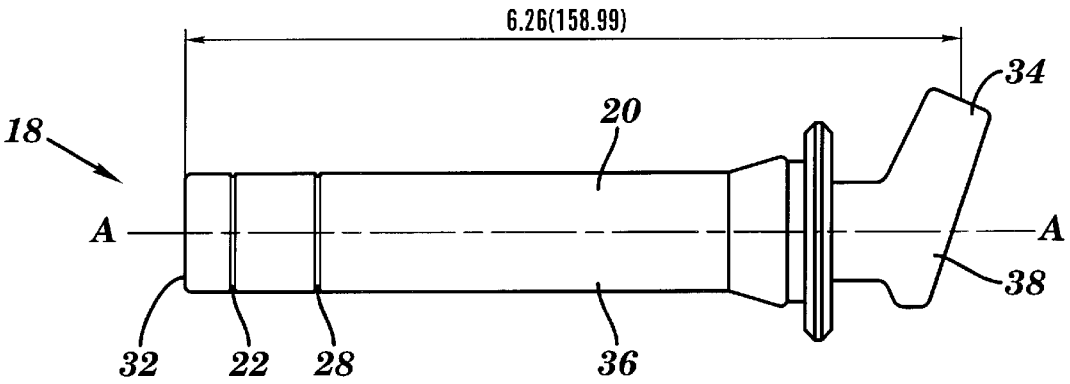
FIG. 2 is a side view of a spark plug boot in accordance with the present invention.
Figure 3:
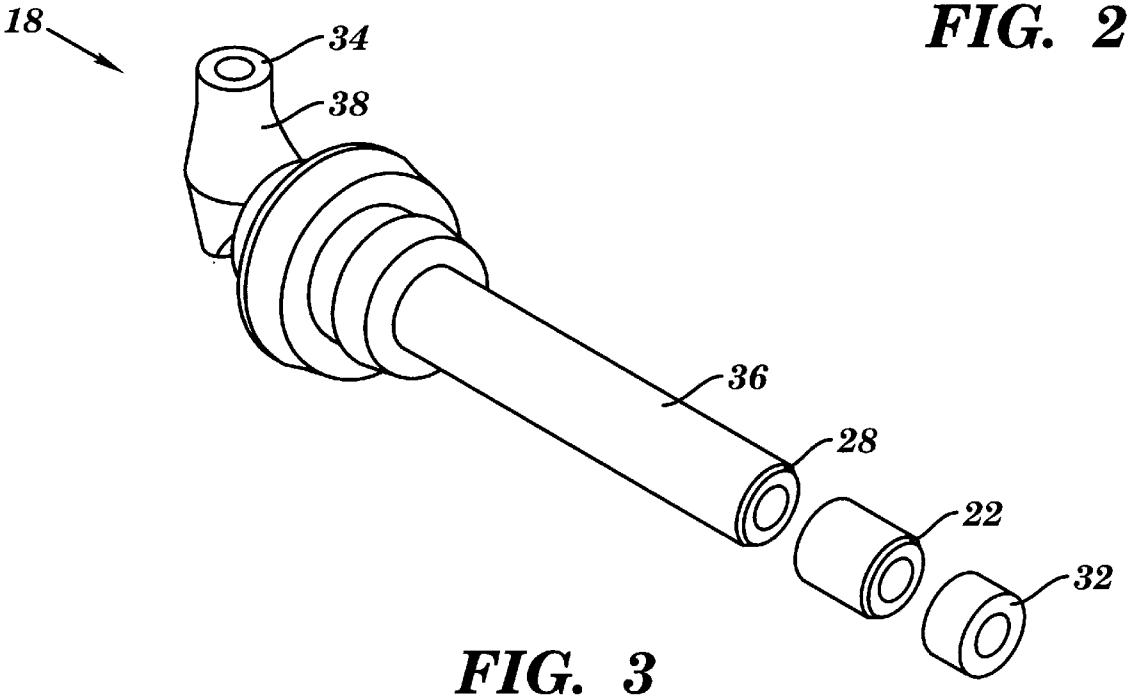
FIG. 3 is an exploded, perspective view of the spark plug boot in accordance with the present invention.

Referring more specifically to FIGS. 2 and 3, spark plug boot comprises an elongated assembly 20 with two ends. In this particular embodiment, the assembly 20 has a tapered, tubular section 36 which extends from end 32 to an angled section 38 which extends to end 34, although the assembly 20 can be formed to have other shapes. The tubular section 36 extends along an axis A—A. Additionally, in this particular embodiment, the assembly 20 is a one-piece construction made of rubber. One of the advantages of the adjustable spark plug boot 18 is that since a one piece design is used, the boot can be manufactured with a single mold.

The tubular section 36 includes a pair of grooves 22 and 28 which extend around the section 36. In this particular embodiment, grooves 22 and 28 are continuous, although other types of cutting marks could be used and the grooves 22 and 28 or marks do not need to be continuous. With the grooves 22 and 28, the assembly 20 can be left alone to form a spark plug boot 18 with a length of 6.26", can be cut orgtrimmed at the first groove 22 to form a spark plug boot 18 with a length of 5.88", and can be cut or trimmed at the second groove 28 to form a spark plug boot 18 with a length of 5.18"as shown in FIGS. 3–6, although the length of the spark plug boot can be adjusted, if needed or desired.

Figure 4A:
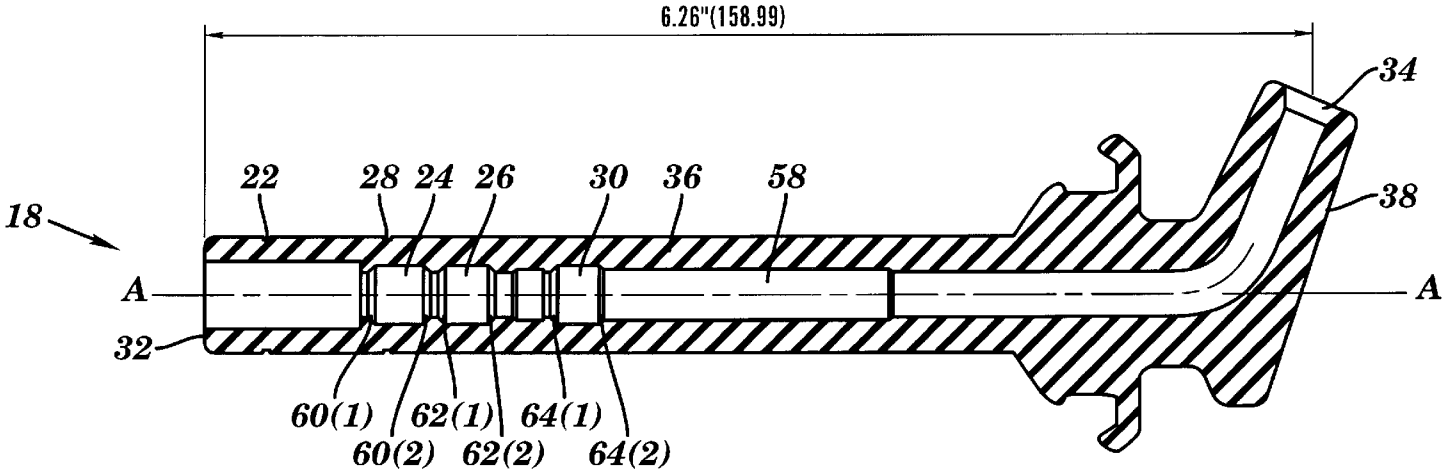
FIG. 4(*a*) is a cross-sectional view of the spark plug boot in accordance with the present invention.
Figure 4B:
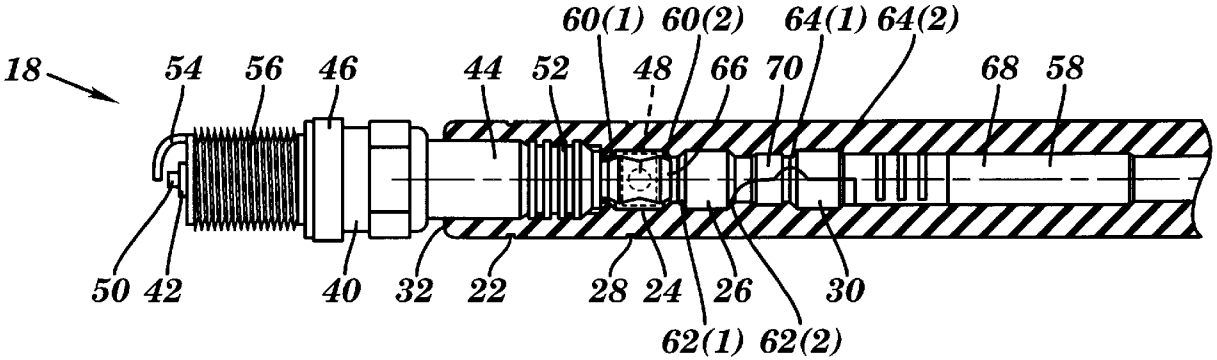

Referring to FIGS. 4(*b*), 5(*b*), and 6(*b*), spark plug 40 typically includes a center conductor 42, a ceramic insulator 44 and a metal casing 46. The center conductor 42 comprises a terminal 48 for the spark plug at one end and an electrode 50 for the plug at the other end. The conductor 42 is surrounded by the ceramic insulator 44 and the ceramic insulator 44 has a corrugated section 52 adjacent the terminal 48. The metal casing 46 surrounds a portion of the ceramic insulator 44 opposite from the corrugated section 52 and adjacent the electrode 50. Typically, the distance from the tip 66 of terminal 48 to the start of the metal casing 46 is about 1.92". the diameter of the corrugated section 52 of the ceramic insulator 44 is about 0.40", and the diameter of the terminal 48 is about 0.25". The metal casing 46 includes another electrode 54 which extends from metal casing 46 towards the electrode 50, but is separated from the electrode 50 by a gap. The metal casing 46 also includes threads 56 which enable the spark plug 40 to be screwed into the cylinder head of an engine, such as the engine disclosed in U.S. Pat. No. 5,382,170 to Imanishi which is herein incorporated by reference.

Referring to FIGS. 3, 4(*a–b*), 5(*a–b*) and 6(*a–b*), the assembly 20 includes a bore 58 which extends from end 32 to end 34. In this particular embodiment, bore 58 is substantially circular and has a diameter of about 0.36" to 0.41" adjacent to end 32. Bore 58 includes three terminal locator chambers 24, 26, and 30 which are located in series in the tubular section 36 of the assembly 20. Each chamber 24, 26, and 30 is defined by a pair of opposing tapered sides 60(1), 60(2), 62(1), 62(2), 64(1), and 64(2). The distance which side 60(2) is spaced from end 32, side 62(2) is spaced from groove 22, and side 64(2) is spaced from groove 28 is substantially the same and is greater than the distance from the tip of terminal 48 to the end of corrugated section 52 facing metal casing 46, but less than the distance from the tip of terminal 48 to the start of metal casing 46. In this particular embodiment, the distance of side 60(2) is spaced from end 32, side 62(2) is spaced from groove 22, and side 64(2) is spaced from groove 28 is about 1.29" although this distance can vary as needed or desired. Additionally, in this particular embodiment, each chamber has substantially the same width, about 0.19", and substantially the same diameter, about 0.35" or 0.36" although the width and diameter can vary as needed and desired.

Figure 5A:
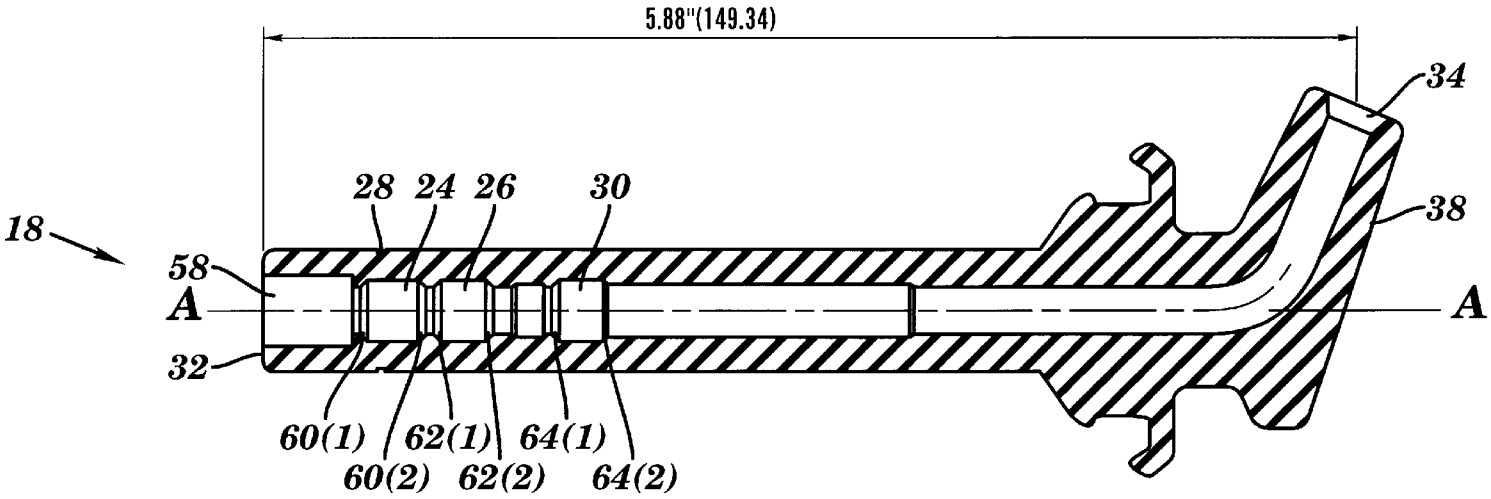
FIG. 5(*a*) is a cross-sectional view of the spark plug boot shown in FIG. 4(*a*) with a first end of the boot trimmed at a first groove.
Figure 5B:
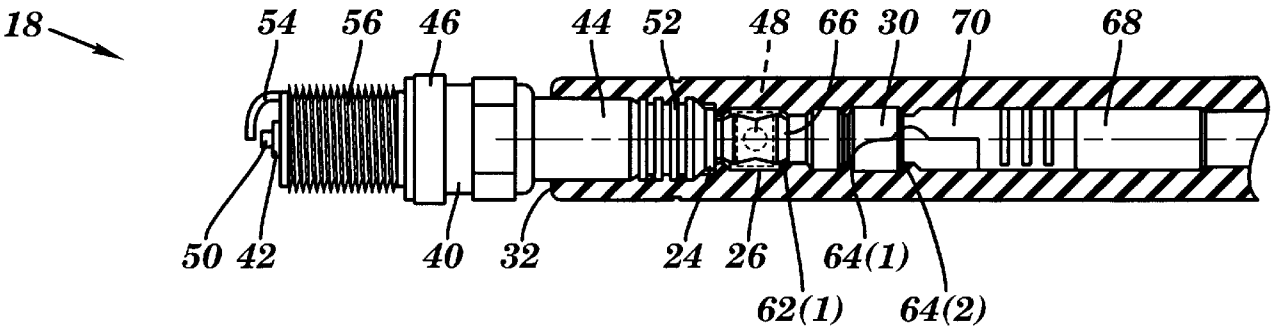
Figure 6A:
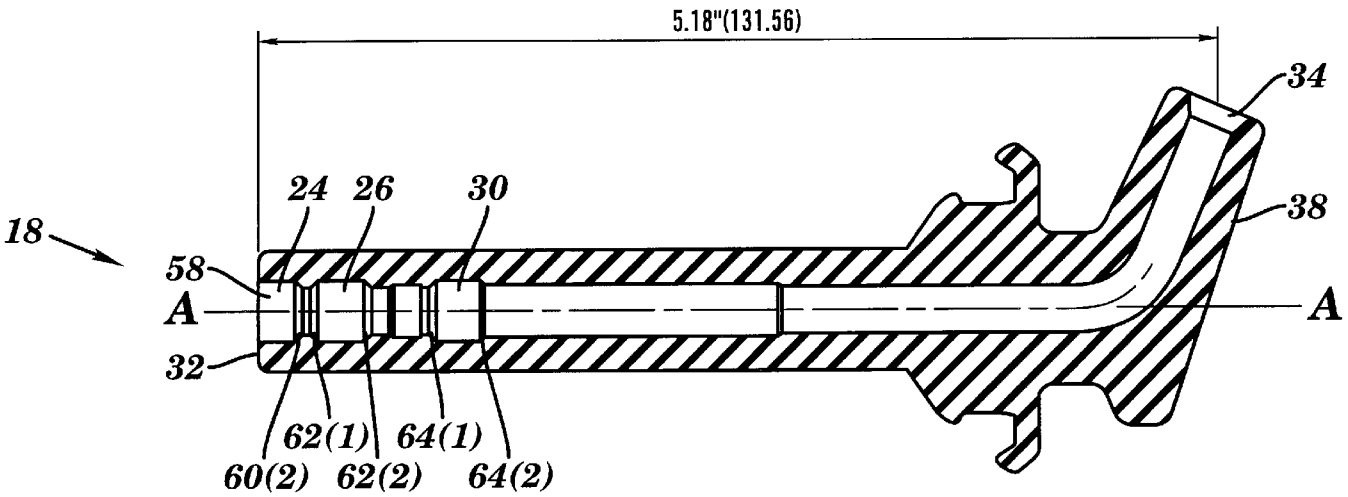
FIG. 6(*a*) is a cross-sectional view of the spark plug boot shown in FIG. 4(*a*) with a first end of the boot trimmed at a second groove.
Figure 6B:
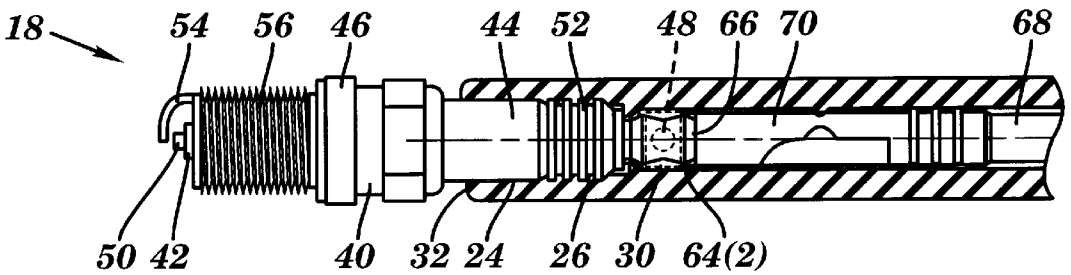

As shown in FIGS. 4(*b*), 5(*b*), and 6(*b*), the assembly 20 is designed so that whenever the terminal 48 or terminal end of spark plug 40 is inserted in end 32, terminal 48 will extend into one of the terminal chambers 24, 26, or 30 and corrugated section 52 will be covered by tubular section 36 of the assembly 20. To adjust the length of assembly 20, a cut is simply made along one of the grooves 22 and 28, as shown in FIGS. 5 and 6, to make spark plug boots 18 with lengths of 5.88" and 5.18", respectively. As a result, one spark plug boot 18 is designed to be easily adjusted to make three different lengths of spark plug boots 18. In this particular embodiment, the three lengths of spark plug boots 18 are 6.26", 5.88", and 5.18" although boots 18 can be designed to have different lengths and to have more or less than three variations in lengths. Accordingly, rather than needing to stock three different lengths of spark plug boots, a business only needs to maintain an inventory of one set of spark plug boots 18 because the one spark plug boot 18 can be adjusted to the three different required lengths. As a result, these businesses are able to significantly reduce their overhead for stocked parts.

Also as shown in FIGS. 4(*b*), 5(*b*), and 6(*b*), a spark plug connector wire 68 includes a first end with a terminal connector 70. The terminal connector 70 is coupled to the wire 68. Any type of terminal connector 76 could be used, such as the electrical connector disclosed in U.S. Pat. No. 4,997,380 to Etienne et al. which is incorporated herein by reference. The wire 68 is coupled in to the adjustable spark plug boot 18 through end 32 and is pulled through the bore 58 in assembly 20 so that the terminal connector 70 is positioned in the appropriate terminal chamber 24, 26, or 30 to make electrical contact with the terminal 48 when the spark plug 40 is inserted in end 32 of spark plug boot 18. Terminal connector 70 is flexible and has a larger diameter than terminal chambers 24, 26, and 28. In this particular embodiment, terminal connector has a diameter of about 0.39", although the diameter can vary as needed. The connector 70 expands in chambers 24, 26, or 30 to hold connector 70 in place.

Referring to FIG. 4(*b*), when terminal 48 of spark plug 40 is inserted in end 32, the tip 66 of terminal 48 is substantially even with side 60(2) of chamber 24 and terminal 48 is located in chamber 24. Terminal 48 fits inside and makes electrical contact with connector 70 is located in chamber 24. Corrugated section 52 is covered by the tubular section 36. Corrugated section 52 has a slightly larger diameter than bore 58, in this particular embodiment about 0.06" larger, which creates a snug fit between corrugated section 52 and tubular section 36.

Referring to FIG. 5(*b*), when terminal 48 of spark plug 40 is inserted in end 32, the tip 66 of terminal 48 is substantially even with side 62(2) of chamber 26 and terminal 48 is in chamber 26. Terminal 48 fits inside and makes electrical contact with connector 70 which has expanded to fill chamber 26. Corrugated section 52 is covered by the tubular section 36 which includes chamber 24. Corrugated section 52 has a slightly larger diameter than bore 58, in this particular embodiment about 0.06" larger, which creates a snug fit between corrugated section 52 and tubular section 36.

Referring to FIG. 6(*b*), when terminal 48 of spark plug 40 is inserted in end 32, the tip 66 of terminal 48 is substantially even with side 64(2) of chamber 30 and terminal 48 is in chamber 30. Terminal 48 fits inside and makes electrical contact with connector 70 which has expanded to fill chamber 30. Corrugated section 52 is covered by the tubular section 36 which includes chambers 24 and 26. Corrugated section 52 has a slightly larger diameter than bore 58, in this particular embodiment about 0.06" larger, which creates a snug fit between corrugated section 52 and tubular section 36.

Having thus described the basic concept of the invention, it will be readily apparent to those skilled in the art that the foregoing detailed disclosure is intended to be presented by way of example only, and is not limiting. Various alterations, improvements and modifications will occur and are intended to those skilled in the art, though not expressly stated herein. These modifications, alterations and improvements are intended to be suggested hereby, and are within the spirit and scope of the invention. Accordingly, the invention is limited only by the following claims and equivalents thereto.

What is claimed is:

1. An adjustable spark plug boot for coupling a spark plug to a spark plug connector in an engine, the boot comprising;

an assembly with first and second ends and a bore extending from the first end to the second end, the assembly including an elongated section which extends from the first end along a first axis;

a first groove extending at least partially around an outer surface of the elongated section and being in a plane which is substantially perpendicular to the first axis;

a first terminal locator chamber located in the bore in the elongated section, the first chamber having a first side which is opposite from the first end and is spaced a first distance from the first end; and a second terminal locator chamber located in the bore in the elongated section and adjacent to the first chamber, the second chamber having a second side which is opposite from the first end and is spaced the first distance from the first groove.

2. The adjustable spark plug boot according to claim 1 wherein the spark plug has a conductor with a terminal and an electrode at opposing ends, the conductor partially covered by an insulator, the insulator having a corrugated section, and a casing covering a portion of the insulator adjacent the electrode, the first distance being less than the distance from the terminal to the casing and greater than the distance from the terminal to the end of the corrugated section.

3. The adjustable spark plug boot according to claim 1 wherein the first terminal locator chamber is defined along the first axis by the first side and a second side and wherein the second side is spaced a second distance from the first end by a portion of the bore in the elongated section.

4. The adjustable spark plug boot according to claim 1 further comprising;

a second groove extending at least partially around the outer surface of the elongated section, being in a plane which is substantially perpendicular to the first axis, and spaced from the first groove; and a third terminal locator chamber located in the bore in the elongated section and adjacent the second chamber, the third chamber having a third side which is opposite from the first end and is spaced the first distance from the second groove.

5. The adjustable spark plug boot according to claim 4 wherein the first, second and third chambers have substantially the same width along the first axis and have substantially the same diameter.

6. The adjustable spark plug boot according to claim 4 wherein the diameter of the first, second and third chambers are substantially the same.

7. The adjustable spark plug boot according to claim 4 wherein the first groove and the second groove are substantially continuous around the elongated section.

8. The adjustable spark plug boot according to claim 4 wherein the assembly is a one-piece construction made from rubber.

9. The adjustable spark plug boot according to claim 4 wherein a second distance from the first end to a center of the bore at the second end is about 6.26", a third distance from the first groove to the center of the bore at the second end is about 5.88", and a fourth distance from the second groove to the center of the bore at the second end is about 5.18".

10. An adjustable spark plug boot for coupling a spark plug to a spark plug connector in an engine, the boot comprising;

an assembly with first and second ends and a bore extending from the first end to the second end, the assembly including an elongated section which extends from the first end along a first axis;

a first cutting mark extending at least partially around an outer surface of the elongated section and being in a plane which is substantially perpendicular to the first axis;

a first terminal locator chamber located in the bore in the elongated section; and a second terminal locator chamber located in the bore in the elongated section and adjacent to the first chamber, wherein the first chamber and the second chamber have substantially the same first width along the first axis.

11. The adjustable spark plug boot according to claim 10 wherein the spark plug has a conductor with a terminal and an electrode at opposing ends, the conductor partially covered by an insulator, the insulator having a corrugated section, and a casing covering a portion of the insulator adjacent the electrode, the first distance being less than the distance from the terminal to the casing and greater than the distance from the terminal to the end of the corrugated section.

12. The adjustable spark plug boot according to claim 10 wherein the first terminal locator chamber is defined along the first axis by the first side and an opposing second side and wherein the second side is spaced a second distance from the first end by a portion of the bore in the elongated section.

13. The adjustable spark plug boot according to claim 10 further comprising;

a second cutting mark extending at least partially around the outer surface of the elongated section, being in a plane which is substantially perpendicular to the first axis, and spaced from the first cutting mark; and a third terminal locator chamber located in the bore in the elongated section and adjacent the second chamber, wherein the third chamber has substantially the same width along the first axis as the first chamber and the second chamber.

14. The adjustable spark plug boot according to claim 13 wherein the diameter of the first, second and third chambers are substantially the same.

15. The adjustable spark plug boot according to claim 13 wherein the first cutting mark and the second cutting mark are grooves.

16. The adjustable spark plug boot according to claim 13 wherein a first distance from the first end to a center of the bore at the second end is about 6.26", a second distance from the first cutting mark to the center of the bore at the second end is about 5.88", and a third distance from the second cutting mark to the center of the bore at the second end is about 5.18".

17. The adjustable spark plug boot according to claim 13 wherein the assembly is a one-piece construction made from rubber.

18. The adjustable spark plug boot according to claim 13 wherein the first chamber having a first side which is opposite from the first end and is spaced a fourth distance from the first end, the second chamber having a second side which is opposite from the first end and is spaced the fourth distance from the first cutting mark, and the third chamber having a third side which is opposite from the first end and is spaced the fourth distance from the second cutting mark.

* * * * *